US005137094A

United States Patent [19]

Broussard

[11] Patent Number: 5,137,094

[45] Date of Patent: Aug. 11, 1992

[54] FIRE FIGHTING FOAM DELIVERY SYSTEM

[76] Inventor: Kenneth W. Broussard, 6956 Hausen, Groves, Tex. 77619

[21] Appl. No.: 795,684

[22] Filed: Nov. 21, 1991

[51] Int. Cl.[5] ..... A62C 15/00; A62C 31/12

[52] U.S. Cl. ..... 169/15; 169/52

[58] Field of Search ..... 169/15, 14, 52, 51, 169/30

[56] References Cited

U.S. PATENT DOCUMENTS 2,044,687 6/1936 Hatten ..... 169/52 X 4,688,643 8/1987 Carter et al. ..... 169/52 X

FOREIGN PATENT DOCUMENTS 115280 4/1939 Sweden ..... 169/15

*Primary Examiner*—Margaret A. Focarino

*Assistant Examiner*—James M. Kannofsky

[57] ABSTRACT

A foam delivery system which may be worn by a fire fighter is disclosed which comprises a foam containing vest formed of two components filled with foam concentrate in fluid communication with a foam aspirating spray nozzle. The front portion of the vest is provided with adjustable connectors or buckles so that the foam vest may adjusted to fit the fire fighter. A connector hose permits fluid communication between the two vest components. The vest components include vertically extending chambers which open to a bottom fluid chamber. The vest is provided with a fill port and a vent opening permitting the foam concentrate to be evenly distributed throughout the foam vest. A valve and hose arrangement connect the vest to the spray nozzle which is connected to a water hose. The spray nozzle includes a venturi nozzle for developing a low pressure zone within the spray nozzle for aspirating foam concentrate into the water stream.

8 Claims, 1 Drawing Sheet

FIRE FIGHTING FOAM DELIVERY SYSTEM

BACKGROUND OF THE DISCLOSURE

This invention is directed to a fire fighting foam system, particularly a foam system incorporated in a vest worn by fire fighter for selective connection to a water hose for spraying foam on a fire.

Fire fighting is a hazardous occupation. Typically, the fire is put out by dousing it with large volumes of water. Water is delivered to the fire through a water hose which is connected to a fire truck or other water source. In the event of a burning liquid or other times when foam is required it is produced by a foam truck, fixed system, in-line eductor or other foam making methods or systems.

While these prior art methods of making and delivering foam to the fire have met with some degree of success, a number of disadvantages exist which are overcome by the present invention. An obvious disadvantage of using a foam truck or other existing methods is that they are not easily positioned close to the fire and rely on people other than the fire fighter to determine when and how much foam solution the fire fighter may receive. These methods require more than one person, in most cases, to perform the foam making procedure. In some instances when the foam concentrate runs out, the fire fighter, who may be several hundred feet away, will not know that the foam concentrate is depleted until it is too late and thus endangers his life and others with him. In the event that a foam concentrate container runs out and the fire fighter is alone, he must turn the water off and go back to the foam making device and restock the concentrate supply, then return to the fire scene and resume fire fighting.

It is an object of the present invention to equip the fire fighter with a foam delivery system which may be selectively actuated to selectively spray foam on a fire as determined by a fire fighter on the scene. This also ensures that the fire fighter is in control of the foam supply. Thus, the fire fighter has the safety factor of knowing how much foam he has left and allows him to develop the strategy in his attack of the fire with minimum risk to life and property.

It is another object of the invention to provide a foam delivery system which may be worn by a fire fighter so that his hands are free to operate and direct a water hose.

It is yet another object of the invention to provide a foam delivery system incorporated in a vest which may be worn by a fire fighter. The vest includes two separate components filled with foam concentrate in fluid communication with each other and the water hose nozzle.

SUMMARY OF THE INVENTION

The present invention is a foam delivery system which may be worn by a fire fighter. The system comprises a foam containing vest formed of two components connected along the back of the fire fighter by two or more connecting straps. The vest is in fluid communication with a foam aspirating spray nozzle. The front portion of the vest is provided with adjustable connectors or buckles so that the foam vest may adjusted to fit the fire fighter. Shoulder straps extend over the shoulders of the fire fighter connecting the front and rear portion of the vest components. A connector hose permits fluid communication between the two vest components. The vest components include vertically extending chambers which open to a bottom fluid chamber. The vest is provided with a fill port and a vent opening permitting the foam concentrate to be evenly distributed throughout the foam vest. A valve and hose arrangement connect the vest to the spray nozzle for delivering foam concentrate to the water stream. The spray nozzle includes a venturi nozzle for developing a low pressure zone within the spray nozzle for aspirating foam concentrate into the water stream.

DETAILED DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

Figure 1:
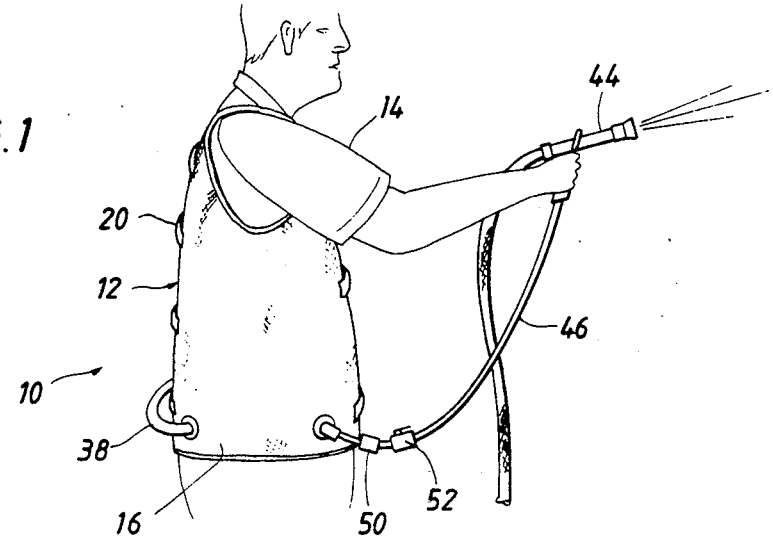
Figure 2:
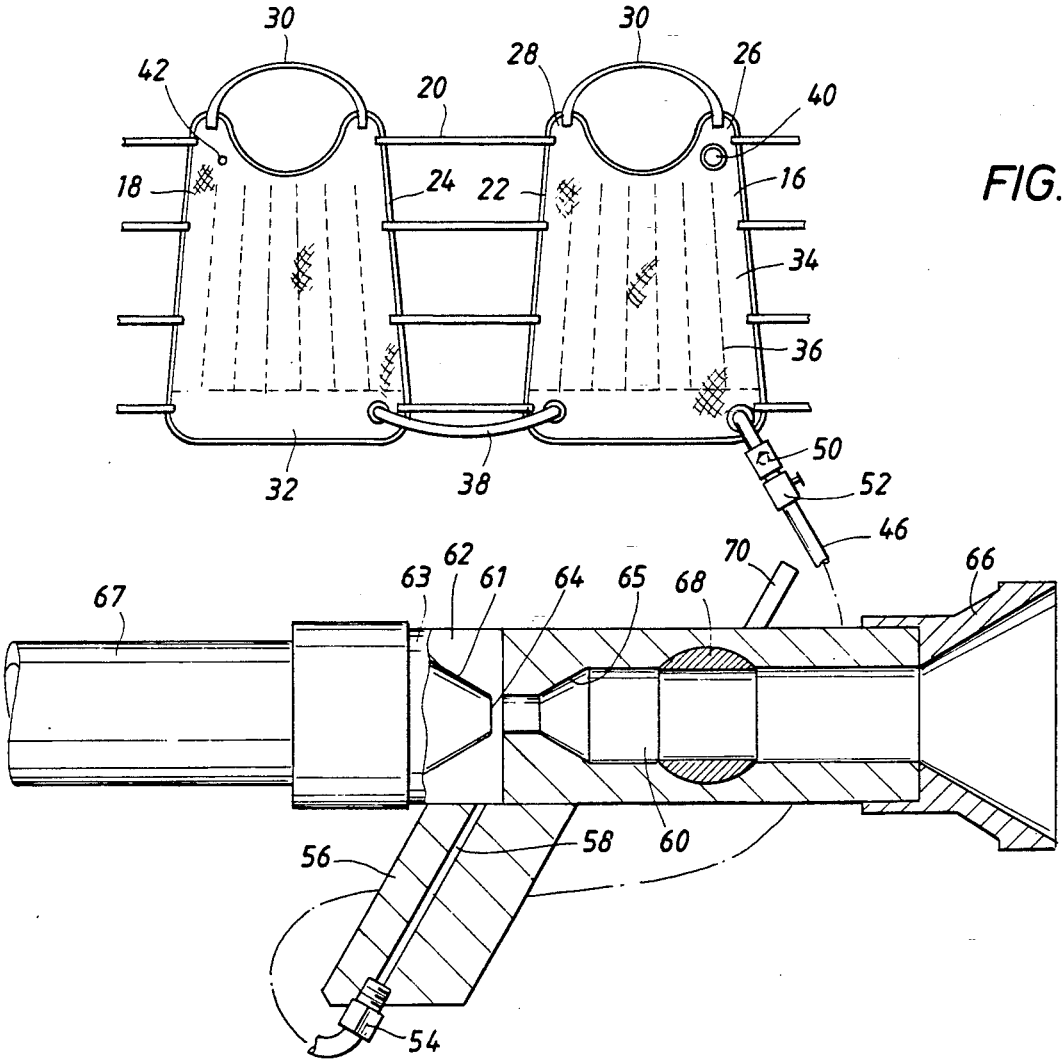

FIG. 1 is a side view of the foam delivery system of the invention illustrating use of the invention by a fire fighter; and FIG. 2 is a plan view, partially broken away, showing the internal fluid channels in the vest of the invention and the fluid passage extending through the water nozzle of the invention.

DETAILED DESCRIPTION OF THE PREFERRED EMBODIMENT

Referring first to FIG. 1, the foam delivery system of the invention is generally identified by the reference numeral 10. As shown in FIG. 1, the foam system 10 comprises a two piece vest 12 worn by a fire fighter 14. The vest 12 includes a right component 16 and a left component 18. The two components 16 and 18 are connected across the back of the fire fighter 14 by connecting straps 20. The straps 20, as shown in FIG. 2, are permanently attached along the rear vertically extending edges 22, 24 of the components 16, 18, respectively. While the straps 20 as shown in FIG. 2, are permanently attached to the components 16, 18, it is understood that the connecting straps 20 may be releasably attached permitting the fire fighter 14 to adjust the components 16, 18 to fit his body profile. For example, the connecting straps 20 may be tied together, or may utilize snap-in connectors, velcro or the like for adjustably connecting the components 16, 18 across the back of the fire fighter 14.

The components 16, 18 are substantially identical in shape and construction. Each component 16, 18 includes an internal rubber bladder for holding the foam concentrate. The internal rubber bladder is covered by an outer jacket formed of fire resistant material, such as canvas or the like. The upper ends of the components 16, 18 are cut to form a semicircular opening to fit under the armpit of the fire fighter 14. The upper, cut-out portions of the components 16, 18 define shoulder portions 26, 28. A shoulder strap 30 extends between the shoulder portions 26, 28 and is securely fastened thereto. The shoulder straps 30 are of sufficient width, or may be provided with shoulder pads, typically in the range of 4 to 6 inches in width, to comfortably carry the load of the foam vest 12 on the shoulders of the fire fighter 14. The shoulder straps 30 are sufficiently wide so that the load of the foam vest 12 is substantially evenly distributed across the shoulders of the fire fighter 14 and do not dig into the shoulders of the fire fighter 14 as may occur with relatively thin shoulder straps.

The components 16, 18 increase in width from the shoulder portions 26, 28 to the lower enlarged portion 32 of the components 16, 18. The enlarged portion 32 of the components 16, 18 is carried about the hip area of the fire fighter 14. This permits the fire fighter 14 to more evenly distribute the load of the foam vest 12, thereby lowering the center of gravity of the fire fighter 14 and enhancing his stability as he engages in the strenuous activity of fighting a fire. Additionally, the enlarged lower portion 32 of the components 16, 18 increases the foam carrying capacity of the foam vest 10 and permits the fire fighter 14 to wrap the lower end of the components 16, 18 around his hip area for more evenly distributing the load of the foam vest 12 and thereby providing more stability.

The internal bladder of the components 16, 18 includes a plurality of vertically extending channels 34 which open into the enlarged portion or bottom chamber 32. The channels 34 are formed by gluing opposing internal surfaces of the internal bladder along the seams 36. The bottom chambers 32 are connected by a foam transfer hose 38 which permits the transfer of foam concentrate between the lower chambers 32 of the components 16, 18. A fill port 40 located on the right component 16 provides access to the internal rubber bladder of the component 16. Both components 16 and 18 may be filled with foam concentrate though the fill port 40. The left component 18 is provided with a vent 42 so that as the components 16, 18 are filled, air escapes from the internal bladder and is not trapped in the upper portion of the component 18, thereby permitting the two components 16, 18 to be filled evenly as foam concentrate is poured or pumped into the components 16, 18 through the fill port 40. The vent 42 permits air to escape as the foam concentrate rises in the channels 34. In this manner, both components 16, 18 are substantially at atmospheric pressure so that the foam concentrate will rise to approximately the same level in each component. Likewise, as the foam concentrate is used, the level of the foam concentrate in each component 16, 18 will decrease at approximately the same rate thereby maintaining a relative even distribution of the load about the body of the fire fighter 14. The channels 34 aid in the distribution of the foam concentrate and prevent the internal bladders from bulging when the foam vest 12 is filled with foam concentrate.

The foam vest of the invention is connected to a spray gun or nozzle 44 via a hose 46. A discharge manifold 48 connects one end of the hose 46 to the right component 16. The discharge manifold extends from a discharge port which opens to the chamber 32 of the component 16. The discharge manifold is provided with a one way check valve 50 to insure that any back pressure from the nozzle 44 is not communicated to the components 16, 18. The hose 46 is connected to a discharge valve 52 which is connected in line with the check valve 50. The opposite end 54 of the hose 46 is connected to the nozzle 44. In FIG. 2, the end 54, for illustrative purposes, is shown as being threadably connected to the hand grip 56 of the nozzle 44. It is understood, however, that other means of connection may be used. For example, a snap-in connector or quick connect coupling may be conveniently substituted for the threaded connection shown.

The nozzle 44, as shown in FIG. 2, is provided with a hand grip 56 having a fluid passage 58 extending therethrough. The fluid passage 58 is adapted to receive the hose connector 54 at the distal end thereof. The fluid passage 58 terminates or opens into a vacuum chamber 62 formed in the nozzle 44. Additionally security against transmission of back pressure to the components 16, 18 may be provided by mounting a check valve in the fluid passage 58.

A venturi nozzle 61 is located at the inlet end 63 of the spray nozzle 44. The venturi nozzle 61 is integrally formed as part of the inlet 63 of the nozzle 44. Alternatively, for convenience in manufacture, the venturi nozzle 61 may be separately manufactured and threadably secured to the inlet end 63 of the spray nozzle 44. The venturi nozzle 61 tapers inwardly and terminates at the end 64. The end 64 of the venturi nozzle 61 extends into the vacuum chamber 62. The end 64 is slightly spaced from the entrance of the fluid passage 60 extending through the nozzle 44 downstream therefrom. The diameter, and thus the cross-sectional area, of the fluid passage 60 increases as it extends toward the outlet end of the nozzle 44. A transmission zone in the fluid passage 60 is defined by the outwardly tapering circumferential wall 65.

A water hose 67 connects the spray nozzle 66 to a water source. As the water jets through the nozzle 44 a vacuum is created in the chamber 62 due to the increased velocity of the water exiting the venturi nozzle 61. The water is accelerated through the reduced diameter of the fluid passage 60 at the entrance thereof. The velocity of the water stream decreases as the fluid passage 60 expands. The fluid passage 60 provides a mixing chamber for the foam concentrate which is drawn into the water stream by the reduced pressure in the vacuum chamber 62, thereby forming a foam spray exiting the nozzle end 66 of the nozzle 44. A ball valve 68 actuated by a handle 70 regulates the amount of water flowing through the nozzle 44.

The foam delivery system 10 of the present invention is particularly useful in that it provides every fire fighter 14 with the capability of spraying foam on a fire as the circumstances dictate. All that is required to use the foam delivery system 10 is a water hose and water under pressure. The foam vest 12 filled with foam concentrate is worn by the fire fighter 14. The vest 12 includes all the necessary buckles and attachments which are required by the fire fighter 14. When the fire fighter 14 is fighting a fire, the nozzle 44 is attached to the water hose 67. The discharge hose 46 is connected to the nozzle 44. The water hose 67 is charged with water and the valve 68 is opened so that the fire fighter 14 may spray water on the fire. When foam is required, the discharge valve 52 is opened thereby drawing foam concentrate into the water stream for mixing therewith in the fluid passage 60 of the spray nozzle 44 to form a foam spray for spraying on the fire.

It will be understood that certain combinations and sub-combinations are of utility and may be employed without reference to other features in sub-combinations. This is contemplated by and is within the scope of the present invention. As many possible embodiments may be made of this invention without departing them from the spirit and scope thereof. It is to be understood that all matters hereinabove set forth or shown in the accompanying drawings are to be interpreted as illustrative and not in limiting sense.

While the foregoing is directed to the preferred embodiment, the scope thereof is determined by the claims which follow.

What is claimed is:

1. A foam delivery system worn by a fire fighter, comprising:

(a) a first vest component defining a first enclosure having a plurality of vertically extending channels opening to a first bottom chamber;

(b) a second component defining a second enclosure having a plurality of vertically extending channels opening to a second bottom chamber;

(c) means connecting said first bottom chamber to said second bottom chamber establishing fluid communication therebetween;

(d) connector means for securing said first component to said second component enabling the vest to be worn by a fire fighter;

(e) means for filling said first and second vest components with foam concentrate;

(f) a spray nozzle connected to a water hose under fluid pressure, said spray nozzle having a fluid passage extending therethrough;

(g) a discharge hose connecting said first bottom chamber to said spray nozzle; and (h) means for aspirating the foam concentrate into said fluid passage for mixing with a water stream flowing through said spray nozzle.

2. The system of claim 1 wherein said means for filling comprises a fill port provided in said first component filling said first and second enclosures with foam concentrate.

3. The system of claim 2 wherein said second component includes a vent port open to atmospheric pressure.

4. The system of claim 3 including a discharge manifold connecting said discharge hose to outlet means providing fluid communication with said first bottom chamber.

5. The system of claim 4 wherein said discharge manifold includes a check valve and a discharge valve positioned in line between said outlet means and said discharge hose.

6. The system of claim 1 wherein said means for aspirating includes a vacuum chamber formed in said spray nozzle and a foam discharge passage opening into said vacuum chamber, wherein said discharge hose is connected to said foam discharge passage.

7. The system of claim 6 wherein said means for aspirating includes a venturi nozzle extending from an inlet end of said spray nozzle into said vacuum chamber for jetting water therethrough creating a pressure differential in said vacuum chamber for drawing foam concentrate into said fluid passage for mixing with the water stream.

8. The system of claim 7 wherein said fluid passage extending through said nozzle expands downstream from said vacuum chamber to form a mixing chamber for mixing the foam concentrate with the water stream for forming a foam spray.

* * * * *